United States Patent [19]

Trompeter et al.

[11] 4,037,909

[45] July 26, 1977

[54] COAXIAL CABLE CONNECTOR WITH ENERGY LOSS PREVENTION

[75] Inventors: Emanuel Trompeter, Tarzana; Tracy A. Hunter, Canoga Park; Claud Azelton, Simi Valley, all of Calif.

[73] Assignee: Trompeter Electronics, Inc., Chatsworth, Calif.

[21] Appl. No.: 694,211

[22] Filed: June 9, 1976

[51] Int. Cl.[2] ..... H01R 17/06

[52] U.S. Cl. ..... 339/177 R; 339/90 C

[58] Field of Search ..... 339/117 R, 177 E, 90 C, 339/143

[56] References Cited

U.S. PATENT DOCUMENTS

| | | | |
|---|---|---|---|
| 2,755,331 | 7/1956 | Melcher | 339/177 R |
| 3,054,981 | 9/1962 | Malek et al. | 339/117 R |
| 3,243,760 | 3/1966 | Dupre et al. | 339/177 E |
| 3,336,566 | 8/1967 | Barker | 339/177 R |

*Primary Examiner*—Roy Lake
*Assistant Examiner*—Neil Abrams
*Attorney, Agent, or Firm*—Matthew P. Lynch

[57] ABSTRACT

An electrical connector including a main body or shell having its rearward end equipped for receiving the end of coaxial cable and having its forward end adapted for telescopic current-transmitting engagement with the shell of a mating connector. Positioned centrally within the shell is a jack or plug unit to which the central conductor of the cable is to be secured while an internal clamping arrangement is provided for fastening the braided outer conductor of the cable to the shell, the latter thus defining the connector outer conductor. A slotted spring contacting member is positioned at the front end of the shell in abutting engagement with the inner peripheral wall thereof such that the entire main body of the spring member is shielded by the shell to prevent radiation and loss of energy through the slots of the spring member in coupled condition of the connector, the spring member additionally including a flange portion protruding directly adjacent the front end of the shell and radially compressible in response to telescopic engagement of the connector shell with the mating connector shell. A dielectric is provided intermediate the spring contacting member and the jack or plug unit.

9 Claims, 4 Drawing Figures

COAXIAL CABLE CONNECTOR WITH ENERGY LOSS PREVENTION

CROSS REFERENCE TO RELATED PATENT

U.S. Pat. No. 3,708,781, issued Jan. 2, 1973, to the same inventor of the present application, is directed to a locking assembly embodied in an electrical connector for securely fastening an electrical coaxial cable to the connector.

BACKGROUND OF THE INVENTION

An electrical connector of the type disclosed in the aforementioned patent includes a pin portion for receiving a central conductor, the latter being insulated from an outer conducting braid wire by a dielectric and the braid wire being covered by an outer insulating member. A cone portion insulated from the pin portion by an inner insulating member includes a first hollow truncated cone member having the smaller end thereof inserted between the dielectric and the braid wire providing for the latter wire and the outer insulating member to be flared outwardly. A second hollow truncated cone member having a plurality of peripheral openings formed therein is placed over the outer insulating member. An inner stepped tapered portion of the connector assembly is clamped down on the second cone member to have portions of the outer insulating member flow outwardly into the openings of the second cone member, thereby providing a secure interlocking between the connector and the coaxial cable.

The locking assembly of the electrical connector includes a shell enclosing the first and second cone members and internal connections of the coaxial cable. Positioned on the connector shell is the usual spring-loaded member having a pair of slots formed therein adjacent its free end. The slots are arranged so as to conventionally slideably receive a pair of locking pins of the mating shell of a second coupling unit, the pins being adapted to ride within the slots during coupling and uncoupling of the two shells. The connector shell includes an end portion formed into a plurality of individual spring contact fingers with slots extending between the fingers. In coupled condition, the fingers of the connector shell securely engage the inner peripheral surface of the mating shell so as to provide an electrical connection between the respective coupling units.

Although the electrical coaxial cable connector of the type under discussion is most satisfactory in that it provides for a reliable locking of the connector to the coaxial cable and a good ground connection for the braid wire, it has been found that connectors of this type inherently generate fields of radiated energy in the area of the mating surfaces between the shell members, typically in the area of frictional engagement between the spaced contact fingers and the inner peripheral contacting surface of the mating shell. Cable connectors prevalently used, employ substantially unshielded ground connection joints and are known to radiate through the medium of the electromagnetic fields in the cable undesired energy from the "open" ground connection on the connector housing, or where applicable, radiates such energy through the slots between the spring contacting fingers. This not only constitutes a source of unwanted radiated interference but, moreover, represents a loss in signal magnitude or energy transmitted through the coaxial cable, the amount of energy loss and radiation depending upon the given construction of the individual connector.

As will be appreciated, such loss of energy tends to vary the transmission characteristics with accompanying ineffectiveness and distortion.

For example, where coaxial cables and connectors are used for radio and television reception and similar transmission systems operating at radio frequencies, it is of prime importance that maximum energy transfer takes place with a minimum amount of signal loss, especially in weak signal areas or fringe areas where the receivers are located a considerable distance from a station. It is imperative, therefore, to provide electrical coaxial cable connectors of the type described with radiation suppression means preventing the leakage and loss of energy from the internal cable connector members.

SUMMARY OF THE INVENTION

The present invention overcomes the aforementioned problems of radiation and loss of energy by providing an electrical coaxial cable connector incorporating a shell member encompassing the inner electrical conductor connections and constituting a continuous shield around such connections.

Typically, the connector according to the invention is designed for use with an electrical coaxial cable wherein the cable has an inner conductor surrounded by a layer of insulating material, a braided outer conductor and an insulating sheath thereabout, the combination comprising, a continuous tubular wall conductive shell defining the connector outer conductor, the shell extending substantially the length of the connector and having an axial through-bore from a larger open rearward end to a smaller open front end, the axial section of bore adjacent the rearward end of the shell being equipped for receiving the end of coaxial cable to be connected to the connector, the axial of bore of the shell adjacent the front end being adapted for telescopic engagement with the counterpart end of the shell of a mating connector in current transmitting relationship therewith, a slotted spring contacting member having a main body entirely enclosed by and disposed in abutting engagement with the axial section of bore adjacent the front end of the shell, the main body being shielded by the shell to prevent radiation and loss of energy through the slots of the spring member in coupled condition of the connector, the spring member additionally including a flange portion protruding directly adjacent the front end of the shell, the flange portion being radially compressible in response to telescopic engagement of the connector shell with the shell of the mating connector, a pin assembly including a pin member having a hollow portion for receiving the inner conductor, a dielectric between the pin member and the main body of the spring contacting member, clamping means for fastening the braided outer conductor to the shell, means for securing the inner conductor to the pin member, and an insulating member between the clamping means and the securing means.

The use of a connector shell which defines the connector outer conductor and which, simultaneously, provides a continuous shield around the slots of the spring contacting fingers thus suppresses, to a high degree, radiation and prevents leakage of energy through the otherwise "open" slots. Moreover, since for optimum transmission of signals a continuous magnetic field is required, the shell structure of the invention provides an uninterrupted, continuous magnetically conductive path between the respective grounding joints in the connector.

The present invention, therefore, is directed to a new combination within an electrical connector so as to provide for optimum strength and electrical characteristics of electrical connections inside the connector. A clearer understanding of the invention will be had with reference to the following description and drawings.

DESCRIPTION OF THE PREFERRED EMBODIMENTS

Figure 1:
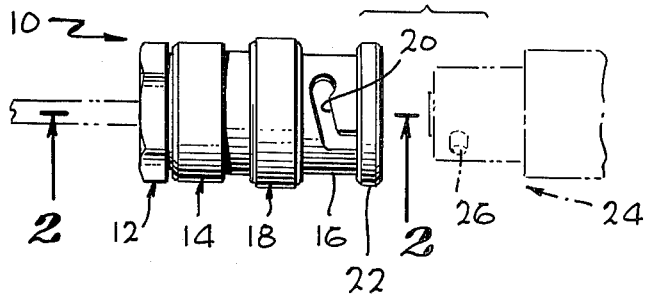
FIG. 1 illustrates an outer view of an electrical connector of the present invention in combination with a coaxial cable and shows in a dotted portion the corresponding mating connector.

Referring now to the drawings in which like reference numerals index like parts and with attention initially directed to FIG. 1, an electrical connector 10 includes a cable locking assembly formed from a nut member 12 and a shell member 14. An outer spring-loaded member 16 is positioned on the shell member and includes the usual knurled portion 18, a pair of slots 20 and a flange portion 22. The connector 10 shown in FIG. 1 is a male connector, as can be seen with more detail in FIG. 2. It is to be appreciated, however, that the internal electrical contact arrangement of the connector which forms the inventive portion of this application may also be used with a female connector which is designed to mate with the male connector 10. For example, as shown in dotted lines in FIG. 1, the female connector 24 may have a pair of pin members 26 which are adapted to ride within the slots 20. Although the invention will be described with reference to the male connector 10, as indicated above, the invention is not limited to such male connector.

Figure 2:
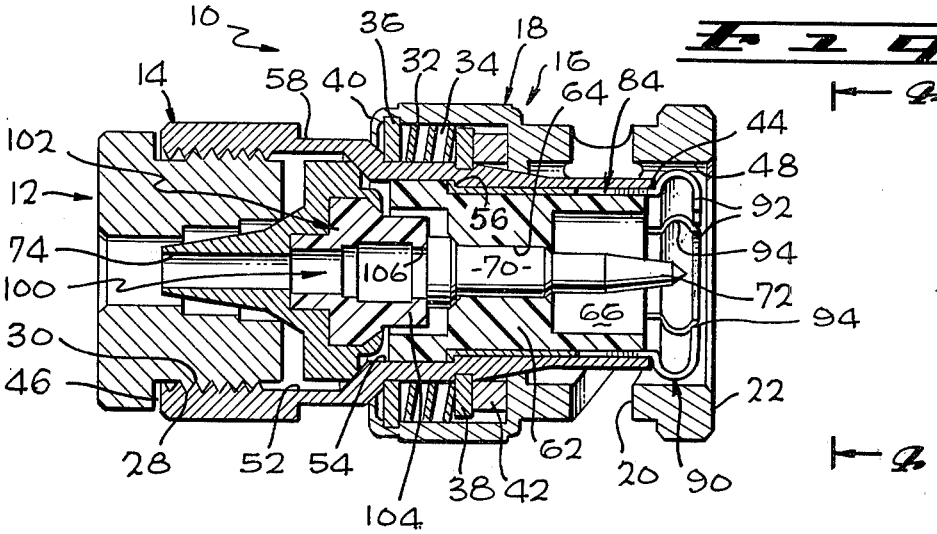
FIG. 2 illustrates a cross-sectional view of the electrical connector of the invention taken along line 2—2 of FIG. 1.

Referring now to FIG. 2, the locking nut 12 is seen to have external threads 28 which mesh with an internal threaded portion 30 of the shell member 14. A spring member 32 is housed within the cavity 34 of the member 16 and maintains pressure between a ring member 36 and a flange portion 38 of the shell 14. The member 18 is slipped over the spring member 32 and the ring member 36 and is crimped downwardly at position 40 so as to lock the member 16 on the shell 14 and allow the member 16 to swivel and also to move in a direction away from the locking nut 12. A second ring member 42 serves as a stop.

Figure 3:
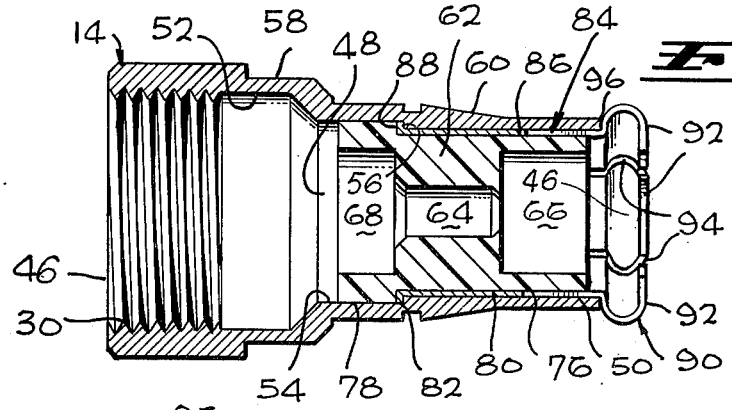
FIG. 3 is a longitudinal sectional view of the shell member incorporated in the arrangement of FIG. 2, however, illustrating in more detail the internal grounding arrangement of the connector.

Referring to FIGS. 2 and 3, the tubular body or shell member 14 includes respective front and rear ends 44, 46. A through-bore 48 of shell member 14 includes a constricted forward bore portion and an enlarged rearward bore portion 52, the constricted bore portion 50 being of stepped configuration where bore portion 50 and intermediate bore portion 54 meet so as to define a rearwardly facing shoulder 56. As shown, the outer peripheral surface 58 of shell member 14 is of generally stepped configuration, terminating in a substantially frustoconical section 60, rearwardly of front end 44.

An insulator 62 is positioned in bore portions 50, 54. The insulator 62 has an axial bore 64 extending therethrough with a relatively large forward counterbore 66 and a relatively small rearward counterbore 68.

Insulator 62 may be composed Polytetraflouroethylene or other suitable dielectric material having sufficient structural rigidity to support a center contact member 70 within the insulator bore 64. Center contact member 70 includes a forward contacting portion 72 that is exposed within the insulator forward counterbore 66 so as to be accessible to a mating contact member from the front of the connector, and the center contact member has an axial recess 74 therein which opens to the rear of the contact member so as to receive the bared forward end of the center conductor of a coaxial cable (not shown).

The outer peripheral surface 76 of insulator 62 is of stepped configuration where peripheral portions 78, 80 meet so as to define a forwardly facing annular shoulder 82. Peripheral portion 78 has a diameter closely corresponding with the inner diameter of intermediate bore section 54 of shell member 14 so as to provide a tight fit between these surfaces. Peripheral portion 80, likewise, has an outer diameter closely corresponding to the inner diameter of bore portion 50 of the insulator 62 for a tight fit therewith.

Figure 4:
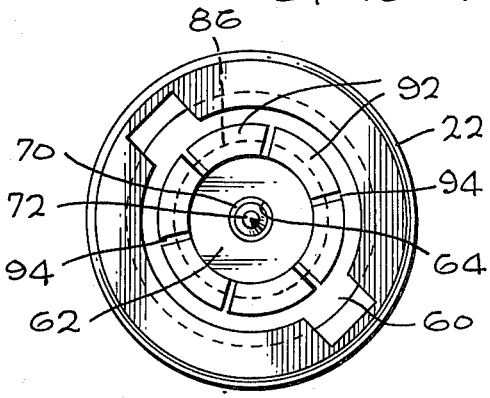
FIG. 4 shows a front view of the electrical connector taken along line 4—4 of FIG. 2.

A slotted annular contact member 84 is positioned in the front axial section of bore 48 adjacent the shell forward end and is sandwiched between outer peripheral portion 80 of insulator 62 and front bore section 50 of shell member 14. As shown in detail in FIGS. 3 and 4, contact member 84 is seen to comprise a main body 86 bounded at its inner end by a radial lip portion 88 and at its opposite outer end by a rim or flange portion 90, formed by the end portions of a plurality of separate spring members 92, spaced a distance apart by slots 94, the latter being in the form of spring contacting fingers. Main body 86 is tightly engaged and locked in position in the front bore portion of shell member 14 by the respective engaging surfaces of bore section 50 and insulator 62. Additionally, contact member 84 is secured against axial movement relative to the connector 10 by lip portion 88 and flange portion 90, the former being sandwiched and locked in position between rearwardly facing shoulder 56 in bore 48 and forwardly facing shoulder 82 in the outer insulator surface 76. Flange portion 90 is formed such as to have arcuate portions thereof abuttingly engaging the forward end face 96 of shell member 14.

Typically, in operation of the connector 10, flange portion 90 serves to securely engage the inner peripheral surface of the mating shell member of the female counterpart of connector 10, in current-transmitting relation therewith, in which condition the flange portion is radially compressed against the bias exerted by the members 92, thereby to provide for a positive electrical connection between the mating shell members.

In addition, in coupled condition of the connector, the frusto-conical outer peripheral surface 60 of shell member 14 extends in electrical contact with the inner peripheral surface of the mating connector shell. This last-mentioned electrical contact and the electrical connection established between flange portion 90 of contact member 84, assures a good low resistance contact between the shell member 14 and the mating connector shell. Moreover, by virtue of the geometry of the frusto-conical surface 60 and flange portion 90, a tight mechanical connection is obtained when the connector 10 is in coupled condition. Furthermore, high structural rigidity and a good ground contact is also achieved between the outer and inner peripheral surfaces of the mating connector shell, on the one hand, and the inner peripheral surface 98 of spring-loaded member 16 and flange portion 88 and frusto-conical surface 60, on the other hand.

Although numerous modes and forms for securing an electrical cable to an electrical cable connector are known, it is herein being suggested as preferred that the cable locking assembly disclosed in the above-mentioned U.S. Pat. No. 3,708,781, is most suitable for use in connection with the connector 10 of the subject application. Suffice it to remark that the center contact member 70 is adequately insulated from the coaxial cable locking assembly, generally referenced by the numeral 100, by means of a dielectric member 102 having the smaller end 104 thereof suitably positioned within the rearward counterbore 68 of the insulator 62. The dielectric member 102 is seen to have a central bore 106 which communicates with the axial bore 64 of insulator 62 for the insertion and passage of the center wire of a coaxial cable for attachment to the contacting portion 72 of contact member 70.

From the foregoing it will be appreciated that in configuring forward annular portion of shell member 14 to extend about main body 86 of contact member 84 to thereby shield the normally exposed slots 94 of the contact member, suppression of electromagnetic energy and radiation thereof is assured, and hence, loss of energy normally taking place through the slots is prevented. Moreover, since shell member 14 constitutes an uninterrupted continuous electromagnetic path both axially and circumferentially, optimum electromagnetic fields are produced providing maximum energy transfer across the electrical ground connection in the connector in the coupled condition thereof.

From a detailed consideration of this description, it will be apparent to those skilled in the art that this invention may be employed in a number of different ways through the use of routine skill in this field. For this reason, the present invention is not to be considered as being limited except by the appended claims defining the invention.

I claim:

1. An electrical cable connector, comprising:

a conductive hollow shell having axially opposite open forward and rearward ends, the rearward end being equipped for receiving the end of the cable to be attached to said connector;

first electrical contact means in said shell adapted to effect an electrical connection between said shell and the electrically conductive means of the cable;

inner and outer second electrical contact means at the forward end of said shell adapted to effect an electrical connection between said shell and the counterpart shell of a mating connector, and shielding means unitary with said inner and outer second electrical contact means in coaxial relationship therewith for preventing electrical interference and loss of energy through the inner one of said second electrical contact means in couple condition of said connector, said shielding means being defined by a forward annular portion of said shell and having an inner cylindrical surface and an outer periphery of frusto-conical configuration, said inner surface abuttingly engaging the inner one of said second electrical contact means and extending substantially the entire length thereof, and said outer periphery being adapted to frictionally engage and urge the mating surface of the counterpart shell into tight mechanical and electrical contact with the outer one of said second electrical contact means in the coupled electrically conductive condition of the shells.

2. An electrical cable connector in accordance with claim 1, wherein said second electrical contact means comprises a main body enclosed by said shell forward annular wall portion in abutting engagement with the axial section of bore of said shell adjacent said shell forward end.

3. An electrical cable connector in accordance with claim 2, wherein said second electrical contact means further comprises an annular contacting portion extending forwardly and radially outwardly with respect to the axial section of bore adjacent said shell forward end, said annular contacting portion being radially compressible by the shell of a mating connector against which said annular contacting portion seats in coupled condition of said connector.

4. An electrical cable connector in accordance with claim 3, wherein said annular contacting portion is integral with said main body, said main body comprising a plurality of individual spring contacting fingers spaceda distance apart by slots and having their free ends terminating in radially outwardly extending flange portions together constituting said annular contacting portion.

5. An electrical cable connector in accordance with claim 3, wherein the axial section of bore adjacent said bore forward end is of stepped configuration so as to define a rearwardly facing shoulder, and wherein said second electrical contact means further comprises anchor means cooperating with said rearwardly facing shoulder.

6. An electrical cable connector in accordance with claim 5, wherein said anchor means comprises an annular radial lip portion seated against said rearwardly facing shoulder, and comprising support means for maintaining said main body in position in the axial section of bore adjacent said shell forward end.

7. An electrical cable connector in accordance with claim 6, wherein said support means comprises an insulator body mounted in the axial section of bore adjacent said shell forward end, said insulator body being of stepped configuration so as to define a forwardly facing annular shoulder abuttingly engaging said radial lip portion seated against said rearwardly facing shoulder.

8. An electrical cable connector, comprising: a conductive hollow shell having axially opposite open forward and rearward ends, the rearward end being equipped for receiving the end of the cable to be attached to said connector; first electrical contact means in said shell adapted to effect an electrical connection between said shell and the electrically conductive means of the cable; second electrical contact means at the forward end of said shell adapted to effect an electrical connection between said shell and the shell of a mating connector in the coupled electrically conductive condition of the shells; and shielding means mating with said second electrical contact means in coaxial relationship therewith for preventing electrical interference and loss of energy through said second electrical contact means in coupled condition of said connector; said shell comprising an axial through-bore and said shielding means being integral with said shell and defined by a forward annular portion thereof in electrical contact with said second contact means, said second electrical contact means comprising a main body enclosed by said shell forward annular wall portion in abutting engagement with the axial section of bore adjacent said shell forward end, said second electrical contact means further comprising an annular contacting portion extending forwardly and radially outwardly with respect to the axial section of bore adjacent said shell forward end, said annular contacting portion being radially compressible by the shell of the mating connector against which said annular contacting portion seats in coupled condition of said container, said axial section of bore adjacent said bore forward end being of stepped configuration so as to define a rearwardly facing shoulder, said second electrical contact means comprising anchor means cooperating with said rearwardly facing shoulder, said anchor means comprising an annular radial lip portion seated against said rearwardly facing shoulder, and support means for maintaining said main body in position in the axial section of bore adjacent said shell forward end and comprising an insulator body mounted in the axial section of bore adjacent said shell forward end, said insulator body being of stepped configuration so as to define a forwardly facing annular shoulder abuttingly engaging said radial lip portion seated against said rearwardly facing shoulder, and wherein said shell forward end has structure associated therewith which provides frictional retention between said shell and the counterpart shell of the mating connector.

9. An electrical connector for cables of the type having an inner conductor and an outer conductor insulated from the inner one, comprising:

a tubular conductive shell defining the connector outer conductor, said shell having open forward and rearward ends and an axial bore between said ends, and having a forward outer circumferential contact surface adapted to electrically connect with the conductive shell of a mating connector, the axial section of bore adjacent said shell rearward end being equipped for receiving the end of the cable to be attached to said connector;

means adapted to effect an electrical connection between the cable outer conductor and said shell; an insulator body mounted in the axial section of bore adjacent said shell forward end, said insulator body having an axial bore extending therethrough;

a center contact mounted in the bore of said insulator body for attachment to the cable inner conductor; and an annular spring contact member having a slotted main body interposed between the axial section of bore adjacent said shell forward end and said insulator body in coaxial relationship with the forward outer contact surface of said shell, and having a contacting portion extending forwardly and radially outwardly relative to the axial section of bore adjacent said shell forward end and in close proximity relative to said end, said contacting portion being radially compressible by the counterpart shell of a mating connector to provide for a secure electrical connection between the respective contact surfaces, said forward outer contact surface of said shell being effective to shield said slotted main body of said spring contact member to thereby prevent electrical interference and loss of energy through the slots of said body.

* * * * *